US005601923A

United States Patent [19]

Koyama et al.

[11] Patent Number: 5,601,923

[45] Date of Patent: Feb. 11, 1997

[54] MONO-DISPERSED IRREGULAR-SHAPED FINE POLYMER PARTICLES

[75] Inventors: Mikio Koyama; Yoshiaki Koizumi; Kenji Hayashi, all of Hino; Jiro Takahashi, Hachioji, all of Japan

[73] Assignee: Konica Corporation, Tokyo, Japan

[21] Appl. No.: 345,006

[22] Filed: Nov. 23, 1994

Related U.S. Application Data

[62] Division of Ser. No. 11,977, Feb. 1, 1993, abandoned.

[30] Foreign Application Priority Data

Feb. 14, 1992 [JP] Japan ..... 4-028180

[51] Int. Cl.[6] ..... G03G 15/06

[52] U.S. Cl. ..... 428/402; 428/357; 428/372; 428/397; 428/401; 430/109; 430/110; 430/111

[58] Field of Search ..... 430/109, 110, 430/111; 428/357, 372, 397, 401, 402

[56] References Cited

U.S. PATENT DOCUMENTS 5,080,992 1/1992 Mori et al. ..... 430/109

5,219,697 6/1993 Mori et al. ..... 430/110

FOREIGN PATENT DOCUMENTS 60-220368 11/1985 Japan .

62-266559 11/1987 Japan .

2-51164 2/1990 Japan .

*Primary Examiner*—Patrick Ryan

*Assistant Examiner*—Rich Weisberger

*Attorney, Agent, or Firm*—Frishauf, Holtz, Goodman, Langer & Chick, P.C.

[57] ABSTRACT

A mono-dispersed fine polymer particle having an irregular shape manufactured by processing a polymer particle dispersing solution in which at least one kind of hydrophilic-hydrophobic amphoteric organic solvent is added to the polymer particle dispersing solution so that particles can be associated with each other. The mutual solubility in water of the hydrophilic-hydrophobic amphoteric organic solvent is in the range from 0.1 to 50%.

15 Claims, No Drawings

MONO-DISPERSED IRREGULAR-SHAPED FINE POLYMER PARTICLES

This application is a division of application Ser. No. 08/011,977, filed Feb. 1, 1993, now abandoned.

BACKGROUND OF THE INVENTION

The present invention relates to an irregular-shaped particle prepared by the method in which a polymer particle is associated with and adhered to other polymer particle, and more particularly to a mono-dispersed irregular-shaped polymer fine particle.

Conventionally, methods of emulsion polymerization, suspension polymerization, and dispersion polymerization are widely known as methods by which particles are prepared by polymerization, and by which spherical particles are easily formed. The irregular-shaped particle is widely used for the basic materials of toners for electrophotography and for paint.

For example, the following method has been disclosed in Japanese Patent Publication Open to Public Inspection No. 266559/1987 in which; after fine particles have been prepared once by the method of suspension polymerization, monomers including a polymerization initiator are added to a dispersing medium so that the monomer reacts with other monomers, and irregular-shaped particles can be obtained. Further, the following method has been disclosed in Japanese Patent Publication Open to Public Inspection No. 51164/1990 in which; fine primary particles having a diameter of not more than 10 μm are made to flocculate together in order to obtain irregular-shaped particles having a diameter of 5 to 25 μm, wherein polyvinyl alcohol, the saponification value of which is 60 to 85%, is used as a dispersing agent.

Further, the following method has been disclosed in Japanese Patent Publication Open to Public Inspection No. 220358/1985, in which; polymer particles are salted out using a salting agent made of acid or its water soluble metallic salts so that aggregated irregular-shaped particles can be prepared.

However, in the aforementioned first example, a large amount of energy is necessary for uniform dispersion, and further, particle sizes are widely distributed, so that it is difficult to prepare irregular-shaped particles with a small diameter. The second example has the same drawback as the first example, and further, has the drawback that it is difficult to separate polyvinyl alcohol, which is used for a dispersing agent, from the particles, so that clean particles can not be obtained.

Further, the third example, which has been disclosed in Japanese Patent Publication Open to Public Inspection No. 220358/1985, has the drawbacks that it is difficult to obtain irregular-shaped particles, the particle size distribution of which is stable, and a large amount of water is necessary to remove a salting agent used for processing.

SUMMARY OF THE INVENTION

The object of the present invention is to provide an irregular-shaped particle having the following advantages: its particle size distribution is narrow; its particle size can be made small; it is not affected by additives; and it can be easily prepared, and is to provide a method for preparing the particle. A further object of the present invention is to develop new avenues of use for the irregular-shaped polymer particle.

The above object can be accomplished by a method in which at least one kind of hydrophilic-hydrophobic amphoteric organic solvent is added to a polymer particle dispersing solution so that particles can be associated with each other.

(A hydrophilic-hydrophobic amphoteric organic solvent)

A hydrophilic-hydrophobic amphoteric organic solvent is necessary to associate polymer particles, which are dispersed in a polymer particle dispersing solution, with each other. In the hydrophilic-hydrophobic amphoteric organic solvent of the present invention, it is necessary that it does not dissolve the polymer particle itself, and has an affinity for the polymer.

A hydrophilic-hydrophobic amphoteric organic solvent, the mutual solubility for water of which is within the range of 0.1 to 50%, is more preferable. The mutual solubility for water is disclosed in "Techniques of Chemistry" Vol. II Organic Solvent [Wiley-Interscience] edited by John A. Riddick, William B. Bunger, and appropriate solvents written therein are selected. These solvents can be selected according to kinds of polymers, molecular weight and others. However, generally, solvents, the mutual solubility of which is small, are selected with respect to the polymers, the molecular weight of which is large.

Examples of hydrophilic-hydrophobic amphoteric organic solvents are as follows, however, the present invention is not limited thereby.

The following can be used: 1-butanol, 2-butanol, isobutanol, 3-butanol, 1-pentanol, 2-pentanol, 3-pentanol, 2-methyl-1-butanol, 2-methyl-2-butanol, 3-methyl-1-butanol, 3-methyl-2-butanol, 2,2-dimethyl-l-propanol, cyclohexanol, 1-hexanol, 2-methyl-l-pentanol, 4-methyl-2-pentanol, 2-ethyl-1-butanol, 1-methyl cyclohexanol, 2-methyl cyclohexanol, acetonitrile, propionitrile, succinonitrile, butyronitrile, isobutyronitrile, benzonitrile. In the above example, 1-butanol, 1-pentanol, or acetonitrile is preferable.

Necessary amounts of these solvents are added to a polymer dispersion solution. In general, an addition amount of the solvent is correlated with an average particle size of an irregular-shaped particle generated thereby, and the average particle size tends to be larger when the addition amount of solvent is increased. Generally, 1 wt % to 200 wt %, preferably 5 wt % to 100 wt % of the solvent is added to a polymer particle dispersing solution. Further, although addition speed can be freely selected, generally, when addition speed is low, dispersion stability of the polymer particle dispersion solution can not be suddenly deteriorated, so that generation of a lump of cohering particles can be suppressed. For example, the hydrophilic-hydrophobic amphoteric organic solvent of the present invention can be added to the polymer dispersing solution of 1 liter at the addition speed of 0.1 to 10 ml/min. Needless to say, more than two kinds of amphoteric organic solvents can be used together. For example, when a solvent, the mutual solubility of which is high, is combined with a solvent, the mutual solubility of which is low, the range in which particles are irregular-shaped is spread, so that particle sizes can be easily controlled. Further, there is an advantage in which the addition amount itself can be reduced.

Further, as the solvent which is added to the dispersion solution, it is possible to use a solvent in which more than two kinds of solvents are mixed together. The solvent to be used is properly selected according to the condition of the surface of a polymer particle, molecular weight of the polymer particle, or the like.

(Heating processing)

In the present invention, when the hydrophilic-hydrophobic amphoteric organic solvent, by which the aforementioned requirement is satisfied, is added to a polymer particle water solution, a particle is associated with and adhered to other particles so that irregular-shaped particles can be easily generated. Further, it is more effective to heat the solution so that particles can be firmly adhered to each other.

The object of heating processing is to firmly adhere a particle to other particles, and therefore, heating processing is preferably conducted in the vicinity of the glass transition temperature of the polymer. For example, when heat processing is conducted within a range of −10° C. to +30° C. of the glass transition temperature, the particle can be firmly adhered to other particles. Further, when a heating time is changed, the shape of the irregular-shaped particle is changed, and a particle, the shape of which is close to a sphere, can be obtained finally. Therefore, the shape of the irregular-shaped particle can be controlled when the heat processing time is changed.

(A hydrophilic-hydrophobic amphoteric organic solvent greatly soluble in water)

Further, it is possible to add a hydrophilic-hydrophobic amphoteric organic solvent greatly soluble in water to the solution before heating processing. Thereby, even when the association is advanced once and a large coarse particle is generated, disassociation occurs and an irregular-shaped particle, a diameter of which is within the correct range can be easily obtained.

In the same way as the aforementioned solvent, the Solvent by which a polymer particle is dissolved is not used. Solvents such as methanol, ethanol, isopropanol, aceton are used for the solvent. As a matter of course, the solvents are not limited to those solvents, such as methanol, and the solvents are properly selected according to physical properties such as solubility of a polymer. An addition amount and an addition speed of the solvent are selected in the same way as the foregoing. For example, the addition amount to the polymer dispersing solution is properly selected within the range of 1 wt % to 200 wt %, and the addition speed is preferably more than 0.1 ml/min to the polymer dispersing solution of 1 liter.

Several preparing processes of an irregular-shaped particle of the present invention are considered in the specification.

For example, the following processes can be described.

[Process 1]

① A process in which a hydrophilic-hydrophobic amphoteric organic solvent is added to a polymer aqueous dispersing solution so that a monomer particle is associated with and adhered to other monomer particles, and an irregular-shaped particle can be obtained.

[Process 2]

① A process in which a hydrophilic-hydrophobic amphoteric organic solvent is added to a polymer aqueous dispersing solution so that a polymer particle is associated with other polymer particles.

② A process in which heating processing is conducted so that adhesion of the particles to each other can be advanced.

[Process 3]

① A process in which a hydrophilic-hydrophobic amphoteric organic solvent is added to a polymer aqueous dispersing solution so that a polymer particle is associated with other polymer particles.

② A process in which a solvent, which is greatly soluble in water, is added to the above solution.

[Process 4]

① A process in which a hydrophilic-hydrophobic amphoteric organic solvent is added to a polymer aqueous dispersing solution so that a polymer particle is associated with other polymer particles.

② A process in which a solvent, which is greatly soluble in water, is added to the above solution.

③ A process in which heating processing is conducted so that adhesion of the particles to each other can be advanced.

Any of the above mentioned preparing processes can be selected depending on the required average particle size or particle size distribution. Especially, the preparing process shown in [Process 4] is one by which the average particle size and particle size distribution can be easily controlled.

Further, in order to obtain irregular-shaped particles as powder, drying processing may be conducted after a filtering process by a widely known method. Of course, in the drying process, it is necessary to dry the filtered products under the glass transition temperature of the polymer particle.

(Particle size, particle size distribution, degree of amorphousness)

Particles with various particle sizes can be prepared at need if their average particle size is larger than that of polymer particles to be used. For example, the average particle size of about 2 to 20 μm is preferable for a toner for electrophotography. The average particle size within the range of about 3 to 10 μm is more preferable.

The width of the particle size distribution can also be controlled depending on necessity. It is very important for the toner for electrophotography to reduce the width of distribution as much as possible.

For the degree of amorphousness, various shapes of cohesion modes of particles can be produced by selecting preparing conditions. For example, the following irregular-shaped cohesion modes can be produced: an association mode (the shape of a bunch of grapes), in which particles are connected with each other at least at one connecting point, like a pearl necklace made round; the shape of a raspberry in which particles are connected with each other under the most closely packed condition; and the shape of a potato, on the surface of which irregularities exist due rather to adhesion of particles than connection of particles.

The following degree of amorphousness can be used as an index by which the degree of amorphousness of these cohering particles is expressed.

The degree of amorphousness = [BET specific surface of an irregular-shaped particle] / [BET specific surface when assuming the diameter of a particle as that of a sphere]

When the degree of amorphousness is 1, the index means that the particle is a spherical particle. For example, when the irregular-shaped particle of the present invention is used for the toner for electrophotography, the degree of amorphousness is preferably within the range of 1.2 to 10, and more preferably within the range of 1.5 to 5.0. Generally, in the toner for electrophotography, when the degree of amorphousness goes over 5, the toner tends to be destroyed in a developing unit, and when the degree of amorphousness is less than 1.5, inferior cleaning tends to occur.

(Polymer particles)

Polymer particles can be prepared by the widely known methods of emulsion polymerization, suspension polymerization, and dispersion polymerization, and the like. According to the prior art, the polymer particles are obtained in the following manner, in which: an ethylenicaly unsaturated monomer which can be radical-polymerized, (which is called a monomer hereinafter), and a radical polymerization initiator are used, and the polymerization is conducted in an appropriate medium using a dispersing agent when necessary.

In the polymerization initiator, a water soluble initiator is used for emulsion polymerization, and an oil soluble initiator is used for suspension polymerization and dispersion polymerization. For the water soluble initiator, for example, the followings can be used: peroxodisulfate salt (potassium peroxidisulfate, ammonium peroxidisulfate), a water soluble azo type initiator (4,4'-azobis (4-cyanovaleric acid), 2,2-azobis (2-amidinopropane) dibasic acid salt), and water soluble peroxide compound (for example, hydrogen peroxide). For the oil soluble initiator, for example, the following can be used: an oil soluble azo type initiator (2,2-azobis (isobutyronitrile), 2,2-azobis (2,4-dimethylvaleronitrile)), and oil soluble peroxide compound (benzoyleperoxide). Further, these initiators can be combined with reducing agents and used as a redox type initiator. For examples of reducing agents, the followings are described: sodium metabisulfite, ferrous chloride, ascorbic acid, and the like.

For dispersing reagents, the following can be used: surface active reagents made of low molecular weight compounds (anionic, cationic, nonionic); high molecular weight compounds, which are polyvinyl alcohol, polyvinyl pyrrolidone, and hydroxy alkyl cellulose; and colloidal inorganic compound, which are calcium tertiary phosphate, colloidal silica, and colloidal alumina. Especially, calcium tertiary phosphate which can be easily removed after particles have been produced, is preferable as the dispersing agent for suspension polymerization.

From polymer particles produced by emulsion polymerization, particles which have monodispersibility and high particle size distribution, can be easily produced. This method is appropriate for producing irregular-shaped particles, the particle size of which is within the range of 2 to 15 μm. Further, soap-free emulsion polymerization, which is a kind of emulsion polymerization, can produce particles having monodispersibility without using any surface active reagent. This method is appropriate for producing irregular-shaped particles because changes of physical properties by undesired foreign matters entering into the particles hardly occurs when irregular-shaped processing is conducted.

For dispersing agents, the following chemicals can be used: water soluble high molecular weight compounds (gelatin, tragacanth gum, starch,methyl cellulose, hydroxyethylcellulose, carboxymethylcellulose, polyvinyl alcohol, polyvinyl pyrrolidone, polyacrylic acid salt), and insoluble fine particle inorganic compounds (barium sulfate, calcium sulfate, barium carbonate, calcium carbonate, magnesium carbonate, calcium phosphate, talc, bentonite, diatomaceous earth, and clay).

Further, the following chemicals can be used: sulfonate (dodecylbenzensodiumsulfonate, allyl alkyl polyether sodium sulfonate, 3,3-disulfone diphenylurea-4,4-diazobis-amino-8-naphthol-6-sodium sulphate, orthocalboxybenzen-azodimethylaniline, 2,2,5,5-tetramethyl triphenylmethan-4, 4-diazobis-β-naphtol-sodium sulfonate), which are used for surface active agents; sulfuric esther salt (tetradecyl sodium sulfate, pentadecyl sodium sulfate, octyl sodium sulfate); and fatty acid salt (sodium oleate, sodium laurate, sodium capric acid, sodium caprylate, sodium caproate, potassium stearate, calcium oleate).

A monomer, which is an ethylenic unsaturated monomer and which can be radical-polymerized, is preferable for the monomer which is used in the present invention. For example, the following monomers can be used: monovinyl aromatic monomer, (meta) acrylic ester monomer, vinyl ester monomer, vinyl ether monomer, monoolefin monomer, diolefin monomer, olefin halogenide monomer, and polyvinyl monomer.

For vinyl aromatic monomers, for example, the following styrene monomers and their derivatives can be used: o-methyl styrene, m-methyl styrene, p-methyl styrene, p-methoxy styrene, p-phenyl styrene, p-chloro styrene, p-ethyl styrene, p-butyl styrene, p-t-butyl styrene, p-hexyl styrene, p-octyl styrene, p-nonyl styrene, p-decyl styrene, p-dodecyl styrene, 2,4-dimethyl styrene, and 3,4-dichloro styrene. For acrylic monomers, the followings are described: acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxy ethyl acrylate, γ-propyl aminoacrylate, stearyl methacrylate, dimethylaminoethyl methacrylate, and diethylaminoethyle methacrylate.

For vinyl esteric monomers, the following can be used: vinyl acetate, vinyl propionate, and vinyl benzoate.

For vinyl ether polymers, the following can be used: vinyl methyl ether, vinyl ethyl ether, vinyl isobutyl ether, and vinyl phenyl ether.

For olefin monomers, the following monomers can be used: monoolefin monomers such as ethylene, propylene, isobutylene, 1-butene, 1-pentene, and 4-methyl-1-pentene; and diolefin monomers such as butadiene, isoprene, and chloroprene.

Further, bridge forming monomers may be added in order to improve characteristics of polymerized particles. For bridge forming monomers, the following monomers, which have more than two unsaturated bonds, can be used: divinylbenzen, divinylnaphthalene, divinylether, diethylene glycol methacrylate, ethylene glycol dimethacrylate, polyethylene glycol dimethacrylate, and diallyl phthalate.

The above-described monomers can be used for the present invention, independently or in combination of more than two kinds of polymers according to the purpose. Further, water soluble monomers, ionic monomers, or monomers having functional groups can be used for the present invention depending on the necessity.

(Coloring agents)

For black pigments, carbon black, and graft processed carbon black can be used. For cyan or green pigments, the following can be used: C. I. pigment blue-15, C. I. pigment blue-15: 2, C. I. pigment blue-15: 3, C. I. pigment blue-16, C. I. pigment blue-16, C. I. pigment blue 60, and C. I. pigment green 7.

For magenta or red pigments, the following can be used: C. I. pigment red 2, C. I. pigment red 3, C. I. pigment red 5, C. I. pigment red 6, C. I. pigment red 7, C. I. pigment red 15, C. I. pigment red 16, C. I. pigment red 48 : 1, C. I. pigment red 53 : 1, C. I. pigment red 57 : 1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, and C. I. pigment red 222.

For yellow or orange pigments, the following can be used: C. I. pigment yellow 12, C. I. pigment yellow 13, C. I. pigment yellow 14, C. I. pigment yellow 15, C. I. pigment yellow 17, C. I. pigment yellow 93, C. I. pigment yellow 94, C. I. pigment yellow 138, C. I. pigment orange 31, and C. I. pigment orange 43.

Further, a magnetic substance can also be used for the coloring agents.

For the magnetic substance, for example, the following can be used: powder of a ferromagnetic material such as iron, cobalt, or nickel; and powder of metallic compounds such as magnetite, hematite, or ferrite.

These magnetic substances can be used with the pigments, or independently.

Further, these pigments and magnetic substances can be used with a widely known dye.

These organic and inorganic pigments are used independently or plurally according to the necessity. They are selected for generating necessary colors. In the foregoing, about 2 to 20 parts, (wt %), preferably about 3 to 15 parts of the polymer are selected for the number of parts of the pigment. Widely known surface processing can be performed so that the pigment can be involved in particles generated by the method of emulsion polymerization. Silane coupling agents or metallic salts of higher fatty acid are used for surface processing agents.

Coloring agents can be contained in the polymer particle, if necessary. For example, a necessary amount of the coloring agent can be contained in the polymer particle when monomers have been dispersed previously and then they are polymerized.

Toners for electrophotography:

When the polymer of the present invention is used for toners for electrophotography, it is necessary that components to be added to the polymer as the toner are contained inside the polymer. Coloring agents, charge control agents, and fixing property improvers can be used as the components. For example, a desired amount of pigment can be introduced into the polymerized particles when they are generated. In the same way, other components can be introduced into the polymerized particles.

For coloring agents, dye and pigments are generally used, in which pigments having high weather resistance are widely used. For pigments, black pigments such as carbon black or graft-processed carbon black, or the above-described coloring agents such as color pigments can be used.

The ratio of the content of pigments used for polymers is within the range of about 0.5 to 10 wt %. Further, it is arbitrary to set the desired content ratio. The surface of the pigment can be surface-processed so that the dispersibility of the particles can be increased. When the surface of the pigment is processed to have lipophilic property with a widely known surface processing agent, for example, a silane coupling agent, affinity for monomers is increased and the dispersibility of the pigment in polymerized particles can be increased.

(A fixing property improver)

A widely known improver is used for the fixing property improver. Generally, a polyolefin is used. For example, the following can be used: low molecular weight polyethylene; low molecular weight polypropylene; oxidation-processed polyethylene and polypropylene; and acid-modifying-processed polyethylene and polypropylene. These can be processed according to normal methods as follows: after they are fused, they are dispersed into water; they are added in the form of emulsion at the time of emulsion polymerization or seed emulsion polymerization; and they are introduced into polymerized particles. They are preferably added at the time of the seed emulsion polymerization, and they can exist on the surface of the particle as polyolefin fine particles, which is preferable for increasing the fixing property.

Further, polyethylene wax emulsion on the market under the trade name of [HYTEC] (made by Toho Kagaku Kogyo Co., Japan), can be used for the same purpose.

(A charging control agent)

Agents having a widely known structure are used for the charging control agents. However, sometimes they are not necessary when monomers having polar groups are copolymerized on the surface of polymerized particles. The polar group in this case means a group having a positive or negative electric charge, such as a carboxyl group, a sulfonic group, an amino group, or an ammonium salt group.

The following charging control agents having a positive charging property can be used: nigrosine electron donative dye, metallic salt of naphthenic acid or higher fatty acid, alkoxyl amine, quarternary ammonium salt, alkyl amide, metallic complex, pigment, or fluorine processing agent. The charging control agents having a negative charging property can be described as follows: electron acceptable organic complex, chlorinated paraffin, chlorinated polyester, or sulfoneamine of copper phthalocyanine.

When a developing agent is prepared using the polymerized particles as a toner, a magnetic substance used in a two component developer is used as a carrier. The magnetic substance may be used without any coating, or may be dispersed and contained in a resin coating or a resin particle.

Further, prior arts such as addition of a fluidization agent, a charging control fine particle, or a sliding agent can be used in the present invention.

The following can be used as the fluidization agent: inorganic fine powder, or for example, hydrophobic silica, titanium oxide, alumina and their sulfides, nitrides, and nitrogen carbide.

The following can be used as the charging control fine particle: polyvinylidene fluoride, polystyrene powder, polymethyl methacrylate powder, and polyethylene fine powder. Fatty acid metallic salt fine powder can be used as a sliding agent.

DETAILED DESCRIPTION OF THE PREFERRED EMBODIMENT

The example of the present invention will be described as follows.

EXAMPLE 1

(Example of synthesis—1)

| | |
|---|---|
| styrene | 85.0 g |
| butyl acrylate | 15.0 g |
| deaerated ion exchange distilled water | 800 ml |

The above-described monomer composition material was introduced into a polymerization reactor provided with a mixer, a nitrogen introduction pipe, a condencer, and a thermometer, and while the reactor was being mixed at the mixing speed of 300 rpm under the existence of nitrogen flow, the temperature of the inside of the reactor was increased to 70° C. An initiator solution made by the method in which potassium persulfate of 5.49 g was dissolved in deaerated ion exchange distilled water of 200 ml, was added to the reactor. Then, polymerization was performed at the mixing speed of 300 rpm, and at the temperature of 70° C. under the existence of nitrogen flow. After the inside temperature of the reactor had been decreased to room temperature, a solution in the reactor was filtered using a No. 3 glass filter, and polymerized particles were obtained.

Chemical properties of the polymerized particles were as follows: weight average molecular weight (Mw) was 66000, glass transition temperature (Tg) was 74.5° C., average particle size ($d_{50}$) was 0.67 μm, and the degree of dispersion of the particle size ($CV=\sigma_{50}/d_{50}$) was 0.21. This latex was named polymerized particle—(1).

Further, polymerization was performed under the recipe in which only the weight of potassium persulfate was changed to 7.85 and to 3.15, and the rest was the same as the above. Then, polymerized particle—(2) and polymerized particle—(3) were obtained.

Chemical properties of polymerized particle—(2) were as follows: weight average molecular weight (Mw) was 26000, glass transition temperature (Tg) was 74.5° C., average particle size ($d_{50}$) was 0.65 μm, and the degree of dispersion of the particle size ($CV=\sigma_{50}/d_{50}$) was 0.20. Chemical properties of polymerized particle—(3) were as follows: weight average molecular weight (Mw) was 126000, glass transition temperature (Tg) was 74.5° C., average particle size ($d_{50}$) was 0.69 μm, and the degree of dispersion of the particle size ($CV=\sigma_{50}/d_{50}$) was 0.23.

(An example of preparation of an irregular-shaped particles—1)

100 ml of the polymerized particle—(2) was introduced into a reactor provided with a mixer, a thermometer, and a liquid introducing pipe, and further, the liquid introducing pipe was connected with a constant delivery pump, and mixing was performed at a mixing speed of 200 rpm under room temperature. 15 ml of butanol was added at an addition speed of 0.1 ml/min on the above-described condition. After the adding operation was completed, a part of the solution in the reactor was taken out, and an average particle size ($d_{50}$), and a particle size distribution ($\sigma_{50}/d_{50}$) of a particle in the solution was measured (by a laser type diffraction particle size measuring apparatus, SALD-1100, made by Shimazu Manufacturing Co., Japan, hereinafter the same apparatus was used.). Then, particles were partly taken out by a filtering operation, dryed at a temperature lower than Tg, and a BET specific surface area was measured. Further, the temperature of a particle dispersing liquid in the reactor was increased to 85° C., and a reaction was carried out at the mixing speed of 200 rpm for four hours. After that, the temperature was decreased to room temperature, and the average particle size, the particle size distribution, and a degree of amorphousness were measured.

Further, in the same way, 100 ml of polymerized particle—(2) was introduced into the reactor, and mixed. Then, 15 ml of butanol was added at an adding speed of 0.1 ml/min, and after that, 30 ml of isopropanol was added at an adding speed of 0.3 ml/min. After the adding operation had been completed, a part of the solution was taken out. The temperature of the inside of the reactor was increased to 80° C., and the solution was mixed for four hours.

The average particle size, the particle size distribution, and the degree of amorphousness of the particles obtained in the above processes were measured. The result is shown in Table 1.

TABLE 1

| | Average particle size ($d_{50}$) | Particle size distribution ($\sigma_{50}/d_{50}$) | Degree of amorphousness |
|---|---|---|---|
| Irregular-shaped particle - (1) | 12.1 μm | 0.73 | 8.36 |
| Irregular-shaped particle - (2) | 8.3 μm | 0.65 | 5.12 |

As shown in Table 1, it can be understood that particles have good particle size distributions, and the degree of amorphousness can be freely controlled.

(Preparation of irregular-shaped particles—2)

100 ml of each of polymerized particle—(1), polymerized particle—(2), and polymerized particle—(3) were introduced into a reactor, which was provided with a mixer, a thermometer, and a liquid introducing pipe, and further, each liquid introducing pipe was connected with a constant delivery pump, and each reactor was mixed at a mixing speed of 200 rpm under room temperature. A mixed solvent made of 15 ml of butanol and 2.5 ml of pentanol was added to each reactor at an addition speed of 0.1 ml/min. After that, 30 ml of isopropanol was added at the addition speed of 0.3 ml/min, and then the solution in each reactor was heated at the temperature of 80° C. for four hours. Particles obtained in the three reactors were respectively named irregular-shaped particle—(5), irregular-shaped particle—(6), and irregular-shaped particle—(7), and their average particle sizes, particle size distributions, and degrees of amorphousness were measured. The results are shown in Table 2.

TABLE 2

| | Average particle size ($d_{50}$) | Particle size distribution ($\sigma_{50}/d_{50}$) | Degree of amorphousness |
|---|---|---|---|
| Irregular-shaped particle - (5) | 5.8 μm | 0.36 | 2.51 |
| Irregular-shaped particle - (6) | 7.3 μm | 0.31 | 2.03 |
| Irregular-shaped particle - (7) | 4.2 μm | 0.41 | 2.76 |

It can be clearly understood from Table 2 that the irregular-shaped particle can be prepared for any molecular weight.

(Preparation of irregular-shaped particles—3)

100 ml of polymerized particle—(1) was introduced into the reactor, which was provided with a mixer, a thermometer, and a liquid introducing pipe, and further, the liquid introducing pipe was connected with a constant delivery pump, and the reactor was mixed at a mixing speed of 200 rpm under room temperature. A mixed solvent made of 15 ml of n-butanol and 2.5 ml of pentanol was added to the reactor at an addition speed of 0.1 ml/min. After that, 30 ml of isopropanol was added at the addition speed of 0.3 ml/min, and then the solution in the reactor was heated respectively at the temperatures of 70°, 75°, 80°, 85°, 90°, and 95° C. for two hours. Particles obtained by the above processing were respectively named irregular-shaped particle—(8), irregular-shaped particle—(9), irregular-shaped particle—(10), irregular-shaped particle—(11), irregular-shaped particle—(12), and irregular-shaped particle—(13), and their average particle sizes, particle size distributions, and degrees of amorphousness were measured. The results are shown in Table 3.

TABLE 3

| | Average particle size ($d_{50}$) | Particle size distribution ($\sigma_{50}/d_{50}$) | Degree of amorphousness |
|---|---|---|---|
| Irregular-shaped particle - (8) | 2.1 μm | 2.33 | 3.41 |
| Irregular-shaped particle - (9) | 4.3 μm | 0.64 | 2.81 |
| Irregular-shaped particle - (10) | 5.3 μm | 0.52 | 2.37 |
| Irregular-shaped particle - (11) | 6.4 μm | 0.48 | 2.18 |
| Irregular-shaped particle - (12) | 6.3 μm | 0.44 | 2.05 |
| Irregular-shaped particle - (13) | 6.0 μm | 0.41 | 1.94 |

As described above, the particle size, the particle size distribution, and the degree of amorphousness of the irregular-shaped particle of the present invention can be freely prepared according to the heating temperature.

EXAMPLE 2

(Synthesis of colored polymerized particles—1)

1.5 g of carbon black (Regal ®330R; made by Cabot Co., USA) was dispersed into deaerated ion exchange water using dodecylbenzenesodiumsulfonate (called DBS, hereinafter), and a dispersing solution was finally prepared. Density of DBS at the time was adjusted to $1.6\times10^{-3}$ mol/l. The colored polymerized particle was obtained by the following operations: the above-described dispersing solution was introduced into a reactor provided with a mixer, a thermometer, and a nitrogen introducing pipe, together with 21.25 g of styrene, and 3.75 g of butyl acrylate; it was mixed at a mixing speed of 300 rpm while nitrogen was being flown; when the temperature of the inside of the reactor was increased to 70° C., a polymerization initiator solution made by the method in which 1.35 g of potassium persulfate (called KPS, hereinafter) was dissolved in 50 ml of deaerated ion exchange water, was added to the above-described dispersing solution; and then, polymerization was performed for seven hours without any other operation, so that the colored polymerized particle was obtained. Weight average molecular weight (called Mw, hereinafter) was $6.9\times10^4$, Mw/Mn=2.33, glass transition temperature (called Tg, hereinafter) was 69° C., melting temperature (called Tsp, hereinafter) was 134° C., average particle size ($d_{50}$) was 0.61 μm, and particle size distribution CV=0.25.

(Syntheses of colored polymerized particles—2 to 4)

Polymerization was performed in the same way as the method of the above-described synthesis of polymerized particles—1, however, in which the pigment is changed from carbon black (C. B.) to pigment yellow (called PY-17, hereinafter), pigment red 122 (called PR-122, hereinafter), or pigment blue 15:3 (called PB-15:3, hereinafter), and KPS, which is an initiator, is changed to 2.35 g. The results are shown in Table 4.

TABLE 4

| Colored polymerized particle No. | Pigment | $d_{50}$ | CV | Mw | Mw/Mn | Tg (°C.) | Tsp (°C.) |
|---|---|---|---|---|---|---|---|
| Colored polymerized particle - 2 | PY-17 | 0.59 | 0.28 | $3.2\times10^4$ | 2.05 | 67.3 | 133 |
| Colored polymerized particle - 3 | PR-122 | 0.63 | 0.21 | $3.4\times10^4$ | 2.18 | 68.5 | 138 |
| Colored polymerized particle - 4 | PB-15:3 | 0.53 | 0.23 | $3.7\times10^4$ | 2.26 | 67.1 | 136 |

(Synthesis of colored polymerization particles—5)

Styrene of 90 weight parts and butyl acrylate of 10 weight parts, which are monomers, carbon black of 5 weight parts, and polypropylene of 5 g were fully and uniformly mixed by a sand grinder, 2,2'-azobis (2,4-dimethylvaleronitrile) of 1.8 weight parts was added thereto, and they were dissolved.

① $Na_3PO_4\cdot12H_2O$ of 25.6 weight parts and ion exchange water of 53.4 weight parts, ② $CaCl_3$ of 11.2 weight parts and ion exchange water of 102 weight parts, and ③ dodecylbenzenesodiumsulfonate of 0.004 weight parts were mixed, so that an aqueous medium including water insoluble tricalcium phosphate [$Ca_3(PO_4)_2$] was prepared.

In suspension polymerization, when weight of monomers is defined as M, weight of an aqueous medium is defined as W, and weight of tricalcium phosphate is defined as CP, the monomers were put into the aqueous medium so that the values of M/W=0.57 and CP/M=9.5 could be obtained, and then it was mixed to be dispersed for 30 minutes at the mixing speed of 10000 rpm by Homomixer (made by Tokushu Kika Co., Japan), so that a suspension solution could be obtained.

While the suspension solution was being mixed at the mixing speed of 200 rpm under a nitrogen atmosphere, polymerization was performed at the temperature of 70° C. for five hours. After the polymerization had been completed, the polymerized particles were put into a hydrochloric acid solution (pH=2) so that $Ca_3(PO_4)_2$ was dissolved to be removed. After that, they were washed, filtered, and dryed. The polymerized particle thus obtained was evaluated in the same way as the foregoing, and its weight average molecular weight was $7.2\times10^4$, Mw/Mn=2.83, average particle size $d_{50}$ was 1.63 μm, CV=0.49, Tg=68.3° C., and Tsp=139° C.

(Synthesis of a colored irregular-shaped particle)

The above-described colored polymerized particles—1–5 and 100 ml of dispersing solution, in which a density of solid material was 10%, were prepared for the synthesizing operation. While they were being mixed at the mixing speed of 200 rpm, a mixed solvent made of 15 ml of butanol and 3 ml of pentanol, were added thereto at the addition speed of 0.01 ml/min, and further, 30 ml of propanol was added at the addition speed of 0.03 ml/min. After that, it was heating-processed at the temperature of Tg +5° C., taken out after a predetermined time, filtered, and dryed, so that a toner composed of colored irregular-shaped particles was produced. Its conditions and results are shown as follows.

TABLE 5

| Sample | Colored particle | Heating time | Average particle size ($d_{50}$) (μm) | CV | Degree of amorphousness |
|---|---|---|---|---|---|
| Toner of the present invention - 1 | Colored particle - 1 | 2 | 4.81 | 0.56 | 3.57 |
| Toner of the present invention - 2 | Colored particle - 1 | 3 | 5.12 | 0.48 | 2.87 |

TABLE 5-continued

| Sample | Colored particle | Heating time | Average particle size ($d_{50}$) (μm) | CV | Degree of amorphousness |
|---|---|---|---|---|---|
| Toner of the present invention - 3 | Colored particle - 1 | 4 | 5.11 | 0.42 | 2.24 |
| Toner of the present invention - 4 | Colored particle - 1 | 6 | 5.03 | 0.39 | 1.92 |
| Toner of the present invention - 5 | Colored particle - 2 | 4 | 5.53 | 0.47 | 2.18 |
| Toner of the present invention - 6 | Colored particle - 3 | 4 | 5.38 | 0.43 | 2.33 |
| Toner of the present invention - 7 | Colored particle - 4 | 4 | 5.67 | 0.38 | 1.99 |
| Toner of the present invention - 8 | Colored particle - 5 | 6 | 6.78 | 0.53 | 2.87 |

Silica of 2 wt %, and titanium of 1 wt % were added to the above-described colored irregular-shaped toner and they were mixed. Thus processed toner of five parts, and ferrite particles (carrier), the surfaces of which were covered with methyl methacrylate / styrene copolymer, of 95 parts were mixed, and developing agents—1 to 8 of the present invention were prepared.

For comparison, a toner particle, the average particle size of which was 5.2 μm, was prepared by the kneading and powderizing method using styrene/butyl acrylate in which wt %=85/15 (wt %), Mw=$6.8\times10^4$, and the carbon black content was 5 wt %. Further, according to the synthesizing method of the colored particle –5, spheric toners in which their average particle size was 5.3 μm and the degree of amorphousness was 1.03, were synthesized, and prepared in the same way as the foregoing as comparative developing agents—(1), and (2).

The characteristics of the developing agents obtained by the foregoing operation are shown in Table 6.

From the above results, when the degree of amorphousness is increased, the cleaning property of the developing agents of the present invention is slightly lowered, and fine particles are more generated. However, there is no trouble for practical use. On the other hand, in the kneading and powderizing method of comparative developing agents, fog occurrence and inferior cleaning are problematic. Further, it can be clearly understood that the cleaning property of the spherical toner is inferior.

A practical test in which an image was formed by an electrophotographic copying apparatus 'U-Bix 3032' (made by Konica Corporation Ltd. ), which was provided with a heat roller fixing unit and a cleaning blade, was performed using the above-described developing agents, with a view to the following items.

(1) Resolution

A copied image of a fine line chart was formed and the number of lines per 1 mm of distinguishable fine lines was judged therefrom.

TABLE 6

| | Characteristics | | | | | | |
|---|---|---|---|---|---|---|---|
| | | Fog | Hot-offset generating | Toner | Cleaning capacity | Change of particle size distribution (pcs %) | |
| Sample No. | Resolution | (Nos. of fairly copied sheets) | temp. (°C.) | reflection density | (Nos. of copied sheets) | At the time of start | Fog occurrence or 50,000 copies |
| Developing agent of the present invention 1 | 18 (lines/mm) | 8 (× $10^4$) | 230 | 1.35 | 8 (× $10^4$) | 2.3 | 9.2 |
| Developing agent of the present invention 2 | 18 (lines/mm) | 8 (× $10^4$) | 220 | 1.41 | 9 (× $10^4$) | 2.9 | 6.3 |
| Developing agent of the present invention 3 | 20 (lines/mm) | 10 (× $10^4$) | 230 | 1.38 | 10 (× $10^4$) | 1.8 | 2.6 |
| Developing agent of the present invention 4 | 20 (lines/mm) | 10 (× $10^4$) | 230 | 1.36 | 10 (× $10^4$) | 0.9 | 1.8 |
| Developing agent of the present invention 5 | 19 (lines/mm) | 9 (× $10^4$) | 210 | 1.33 | 9 (× $10^4$) | 1.6 | 1.9 |
| Developing agent of the present invention 6 | 20 (lines/mm) | 10 (× $10^4$) | 210 | 1.45 | 9 (× $10^4$) | 1.8 | 3.7 |
| Developing agent of the present invention 7 | 19 (lines/mm) | 8 (× $10^4$) | 210 | 1.42 | 9 (× $10^4$) | 2.1 | 3.6 |
| Developing agent of the present invention 8 | 17 (lines/mm) | 10 (× $10^4$) | 220 | 1.66 | 10 (× $10^4$) | 4.3 | 4.4 |
| Comparative developing agent 1 | 10 (lines/mm) | 7 (× $10^4$) | 190 | 0.98 | 3 (× $10^4$) | 3.4 | 11.6 |
| Comparative developing agent 2 | 9 (lines/mm) | 6 (× $10^4$) | 190 | 1.06 | 2 (× $10^4$) | 3.8 | 3.9 |

(2) Fog

Copied images were continuously formed under normal circumstances in which the temperature was 20° C. and the relative humidity was 60%, and the reflection density of each color on a white background was measured by 'Sakura Densitometer PDA-60' (made by Konica Corporation Ltd.). Then, the fog was judged from the number of copies when the reflection density exceeded 0.02.

(3) Offset generating temperature

A setting temperature of the fixing roller was changed step by step, and the copied image was formed. Then, the setting temperature of the fixing roller was measured when toner stains due to a hot offset were caused.

(4) Colorability of toners

Toner was pasted on a white label in a mono-layer, and the reflection density of each color of the toner layer was measured by 'Sakura Densitometer PDA-60'. The reflection density was expressed by a numerical value.

(5) Cleaning property

The surface of a photoreceptor was visually observed, and the cleaning property was evaluated by the number of copied sheets to the time of inferior copying.

(6) Change of particle size distribution

The change of particle size distribution was evaluated from a time transition of a percentage of the number of toners, the particle size of which was smaller than ⅓ of a volume average particle size. In the practical copying test, the particle size distribution was measured with the passage of time, and the percentage of the number of toners, the particle size of which was smaller than ⅓ of the volume average particle size, measured at the times of start, fog occurrence, and 50,000 sheets copying, was shown in the table. It was measured by the laser diffraction type particle size distribution measuring apparatus SALD-1100 (made by Shimazu Manufacturing Co. Ltd., Japan). The results are shown in Table 6.

According to the present invention, mono-dispersed irregular-shaped polymer fine particles can be prepared under superior control, and further, the polymer particles are effective for use in toners for electrophotography.

What is claimed is:

1. A toner for electrophotography having an irregular shape manufactured by a process which comprises the steps of:

(a) associating mono-dispersed polymer particles in a dispersing solution by adding one kind of hydrophilic-hydrophobic amphoteric organic solvents having mutual solubility in water between 0.1 to 50% to the dispersing solution wherein the polymer particles have an average particle size smaller than the average size of the toner; and (b) adding another kind of hydrophilic-hydrophobic amphoteric organic solvent which has infinite solubility in water to the dispersing solution.

2. The toner of claim 1, wherein the process further comprises the step of heating the dispersing solution after the associating step.

3. The toner of claim 2, wherein said heating step is conducted with the range of −10 to +30° C. of the glass transition temperature of the polymer particles.

4. A toner for electrophotography having an irregular shape manufactured by a process which comprises the steps of:

(a) associating mono-dispersed polymer particles in a dispersing solution by adding one kind of hydrophilic-hydrophobic amphoteric organic solvents having mutual solubility in water between 0.1 to 50% to the dispersing solution, wherein the polymer particles have an average particle size smaller than the average size of the toner;

(b) adding another kind of hydrophilic-hydrophobic amphoteric organic solvent which has infinite solubility in water to the dispersing solution; and (c) heating the dispersing solution within the range of −10 to +30° C. of the glass transition temperature of the fine polymer particles.

5. The toner of claim 1, wherein the one kind of hydrophilic-hydrophobic amphoteric organic solvent is selected from the group consisting of butanol, pentanol and acetonitrile.

6. The toner of claim 1, wherein the another kind of hydrophilic-hydrophobic amphoteric organic solvent having infinite solubility in water is selected from the group consisting of methanol, ethanol, isopropanol and acetone.

7. The toner of claim 1, wherein the degree of amorphousness of the toner is 1.5 to 5.0.

8. The toner of claim 5, wherein the another kind of hydrophilic-hydrophobic amphoteric organic solvent having infinite solubility in water is selected from the group consisting of methanol, ethanol, isopropanol and acetone and the degree of amorphousness of the toner is 1.5 to 5.0.

9. The toner of claim 4, wherein the degree of amorphousness of the toner is 1.5 to 5.0.

10. The toner of claim 1 wherein the toner has an average particle size of about 2 to 20 μm.

11. The toner of claim 3 wherein the toner has an average particle size of about 2 to 20 μm.

12. The toner of claim 4 wherein the toner has an average particle size of about 2 to 20 μm.

13. The toner of claim 1 wherein the toner has an average particle size of 3 to 10 μm.

14. The toner of claim 3 wherein the toner has an average particle size of 3 to 10 μm.

15. The toner of claim 4 wherein the toner has an average particle size of 3 to 10 μm.

* * * * *